US005701688A

United States Patent [19]

Crowley

[11] Patent Number: 5,701,688

[45] Date of Patent: Dec. 30, 1997

[54] PROTECTIVE SHOELACE COVER

[75] Inventor: Kevin J. Crowley, Brentwood, N.H.

[73] Assignee: Fila U.S.A., Inc., Sparks, Md.

[21] Appl. No.: 634,404

[22] Filed: Apr. 18, 1996

[51] Int. Cl.[6] ..... A43B 13/22; A43B 23/26; A43B 3/24

[52] U.S. Cl. ..... 36/72 R; 36/54; 36/101

[58] Field of Search ..... 36/133, 132, 136, 36/72 R, 50.1, 54, 100, 101

[56] References Cited

U.S. PATENT DOCUMENTS

| | | | |
|---|---|---|---|
| Re. 32,585 | 2/1988 | Antonious | 36/50 |
| 332,001 | 12/1885 | Raymond, 2d. . | |
| 1,381,950 | 6/1921 | Van Deusen | 36/54 X |
| 1,603,144 | 10/1926 | Nichols . | |
| 1,974,721 | 9/1934 | Miller | 36/54 |
| 2,022,554 | 11/1935 | Williams . | |
| 2,068,946 | 1/1937 | Ferguson | 36/101 X |
| 2,236,367 | 3/1941 | Grubel | 36/101 |
| 3,175,292 | 3/1965 | MacQuaid et al. . | |
| 3,334,427 | 8/1967 | Edwards et al. . | |
| 3,473,198 | 10/1969 | Meieer . | |
| 3,525,165 | 8/1970 | Randall, Jr. | 36/133 |
| 3,783,534 | 1/1974 | Phillips et al. | 36/72 R |
| 3,822,489 | 7/1974 | Johnson | 36/100 |
| 4,065,861 | 1/1978 | Pelfrey | 36/133 |
| 4,079,527 | 3/1978 | Antonious | 36/51 |
| 4,333,248 | 6/1982 | Samuels | 36/72 R |
| 4,377,913 | 3/1983 | Stone | 36/99 |
| 4,428,101 | 1/1984 | Harkavy | 24/117 |
| 4,536,975 | 8/1985 | Harrell | 36/136 |
| 4,597,199 | 7/1986 | Hong | 36/114 |
| 4,630,383 | 12/1986 | Gamm | 36/136 |
| 4,766,682 | 8/1988 | Malloy, III | 36/132 |
| 4,823,426 | 4/1989 | Bragga | 15/210 R |
| 4,825,564 | 5/1989 | Sorce | 36/7.1 R X |
| 4,845,863 | 7/1989 | Yung-Mao | 36/114 |
| 4,879,787 | 11/1989 | Walls | 24/712.2 |
| 5,042,119 | 8/1991 | Williams | 24/712.3 |
| 5,165,190 | 11/1992 | Smyth | 36/50 |
| 5,209,000 | 5/1993 | Rowland et al. | 36/136 |
| 5,307,569 | 5/1994 | Melcher | 36/58.5 |
| 5,313,719 | 5/1994 | Keothe | 36/72 R |
| 5,416,987 | 5/1995 | Bemis et al. | 36/50.1 |
| 5,421,106 | 6/1995 | Emrick | 36/136 |
| 5,425,186 | 6/1995 | Hoyt | 36/7.3 X |
| 5,459,947 | 10/1995 | Lasher | 36/54 |
| 5,566,477 | 10/1996 | Mathis et al. | 36/100 |

FOREIGN PATENT DOCUMENTS

| | | | |
|---|---|---|---|
| 468532 | 1/1992 | European Pat. Off. | 36/54 |

*Primary Examiner*—B. Dayoan

*Attorney, Agent, or Firm*—Fish & Richardson, P.C.

[57] ABSTRACT

A shoelace cover having a translucent window is detachably secured to the upper of a shoe to display and protect the lacings. The shoelace cover comprises a generally triangular edge element, a translucent window composed of tubular elements and connected to the edge element, and fasteners attached beneath the edge element to detachably secure the cover over the throat area of a shoe upper. The translucent window permits the shoelaces to be seen therethrough, may be of different colors and may house a decorative emblem or feature.

10 Claims, 4 Drawing Sheets

PROTECTIVE SHOELACE COVER

BACKGROUND OF THE INVENTION

It has become popular recently to wear shoelaces of different lengths and colors on shoes, and thus shoe guards are desirable to protect the shoelaces from becoming soiled and to prevent them from untying. However, shoe designs must be contemporary and stylish in order for customers to purchase the shoe. In response to these customer preferences, several prior art shoe guard designs have been proposed.

For example, U.S. Pat. No. 5,313,719 relates to a shoe shield that completely covers the shoelaces. The proposed device is a channel-shaped thermoplastic shell having a tab to secure the front of the shield to the shoelace. The shield completely covers and hides the shoelaces, and is preferably formed of one-piece of thermoplastic material.

U.S. Pat. No. 4,065,861 discloses a shoelace cover that is fixed to one side of the shoe and folds over only a part of the shoelaces, attaching to the other side of the shoe by hook and loop fasteners.

Although these prior art covers prevent soiling and untying of shoelaces, they do not permit viewing of the shoelaces, thus detracting from the contemporary shoe styling that currently is popular.

SUMMARY OF THE INVENTION

A shoelace cover having a translucent window portion for protecting and displaying the shoelaces is disclosed. The shoelace cover has a generally triangular edge element sized to fit over the throat of a shoe, fastening means connected to the underside of the edge element, and a translucent window connected to the inner portion of the edge element. A toe section of the shoelace cover may be permanently attached to the shoe upper, while the remainder is detachably connected. Alternatively, the entire shoelace cover may be detachable from the shoe upper.

The shoelace cover is a decorative shield that is readily detachable and completely covers the shoelaces to protect the laces and to provide a contemporary and stylish appearance.

DESCRIPTION OF THE PREFERRED EMBODIMENTS

Figure 1:
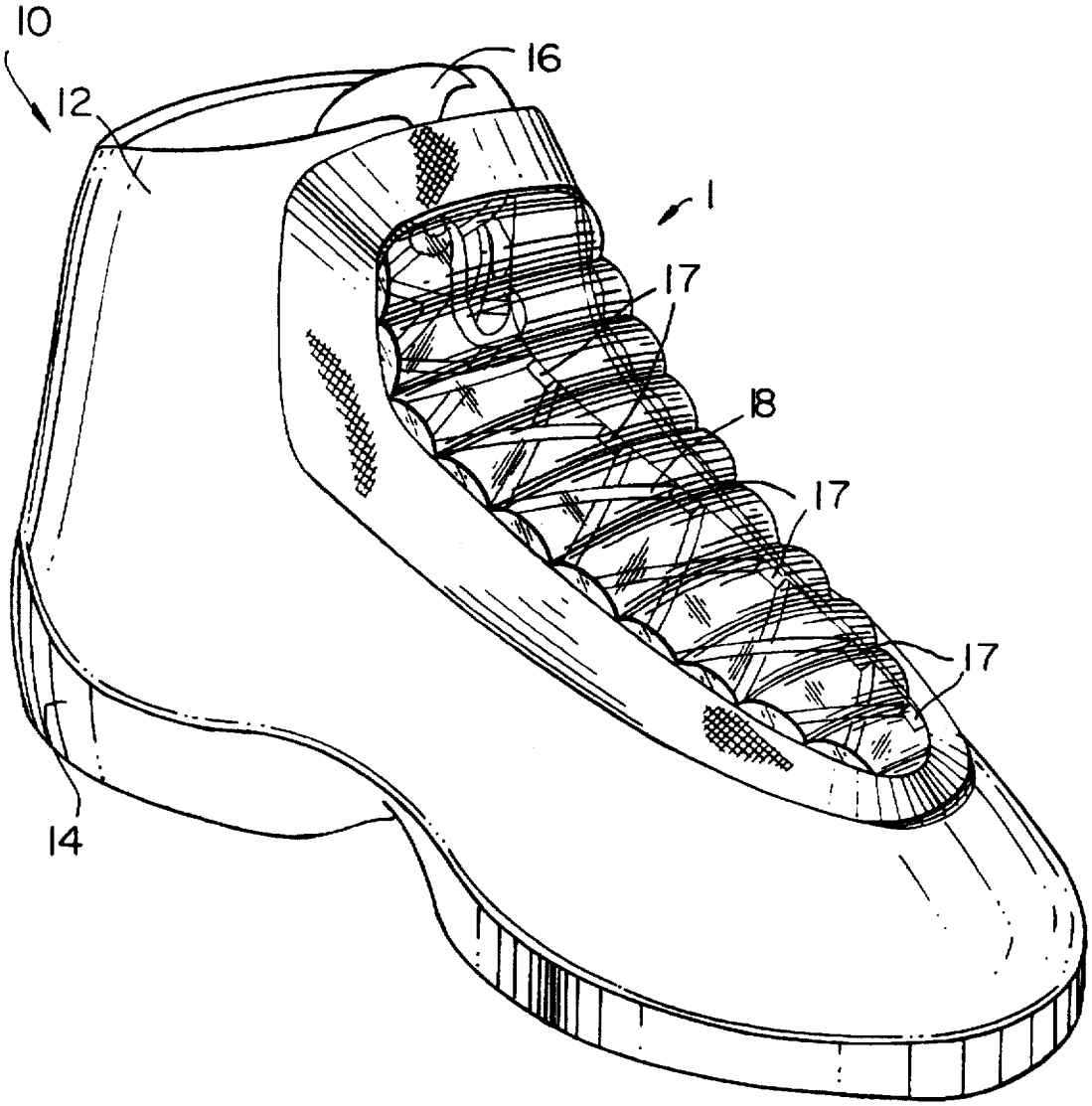
FIG. 1 is a perspective view of an embodiment of a shoelace cover according to the invention shown covering the laces of a shoe.

FIG. 1 is a perspective view of a shoelace cover 1 according to the invention shown covering the shoelace 18 of a shoe 10. As will be apparent from the description that follows, like components have been numbered the same in the various figures.

The shoe 10 is comprised of an upper 12 and a sole 14. The upper 12 includes a throat which has first and second sides containing shoelace guides 17 having the shoelace 18 threaded therethrough. A tongue 16 is typically positioned under the shoelace 18 and contacts the foot of the wearer.

Figure 2:
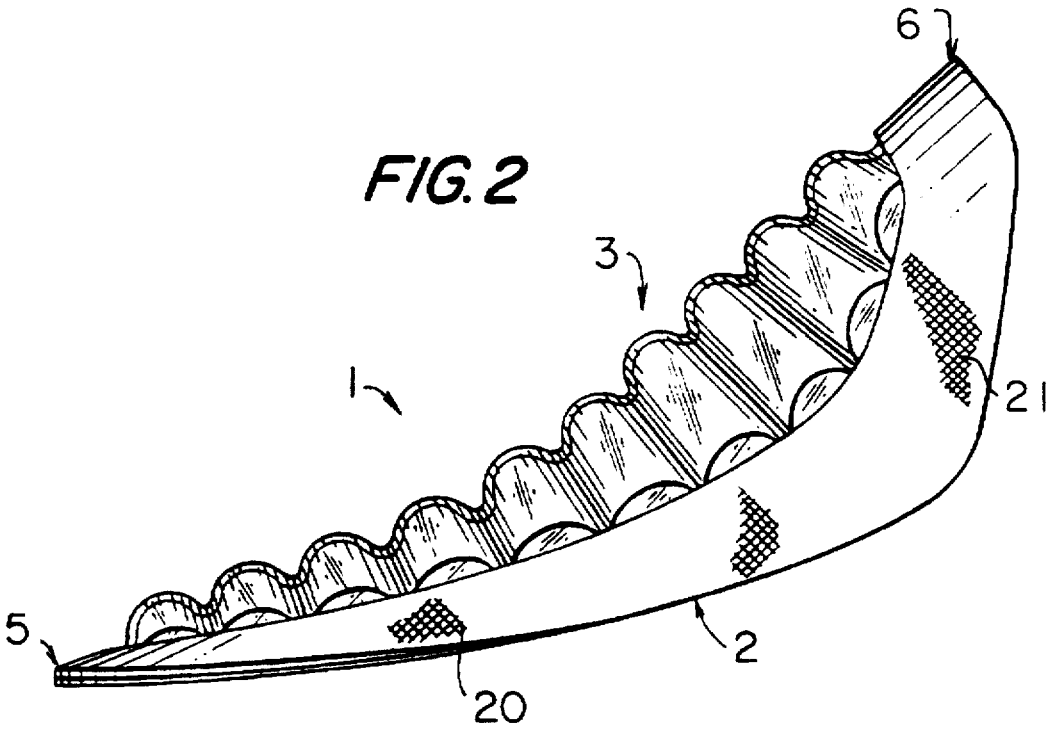
FIG. 2 is a side view of the shoelace cover of FIG. 1.

FIG. 2 is a side view of the shoelace cover 1 shown in FIG. 1. The shoelace cover 1 has a window 3 connected to an inner portion of an edge element 2. The edge element 2 may be made of leather, or of a synthetic material, or of other materials typically used in the shoe art. The translucent window 3 may be formed of a plastics material, and is sewn, glued or otherwise attached to the inside portion of the edge element 2.

The translucent window 3 may be totally clear to permit viewing of the shoelace when the shoelace cover 1 is positioned over the throat of a shoe as shown in FIG. 1. Alternately, the window 3 may be tinted in one or several colors depending on style and consumer tastes. Furthermore, a logo, insignia, cartoon character, decorative emblem, or a word or phrase and the like can appear in or on the translucent window if desired. For example, the logo of a sports team may be molded into the window material such that the logo appears to "float" therein, or an insignia may be applied on top of, or below, the translucent window 3. Further, such applications of logos and the like can be accomplished in a manner to enhance the appearance of the shoelaces which are still visible through the translucent window.

Figure 3:
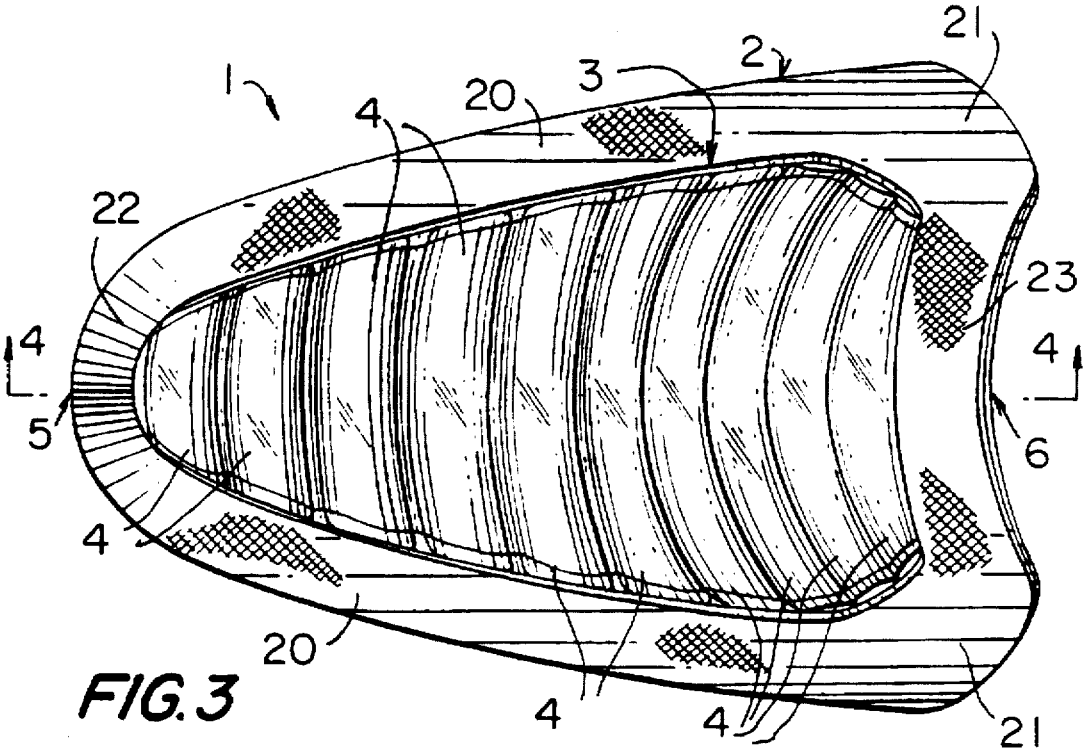
FIG. 3 is a top plan view of the shoelace cover of FIG. 1.

FIG. 3 is a top view of the shoelace cover 1 of FIGS. 1 and 2. The edge element 2 is comprised of two lace length sections 20, two riser sections 21, a toe spanning section 22 and a throat spanning section 23, which defines a generally triangular shape. The translucent window 3 is comprised of a plurality of generally tubular sections 4, which are discussed in more detail below with reference to FIG. 4.

Referring again to FIG. 2, it can be seen that the lace length section 20 and riser section 21 of the shoelace cover 1 define an "L-shape" when the cover is viewed from the side. The shoelace cover 1 shown in the figures has a size from the point 5 to the point 6 that is adequate to substantially cover the shoelace of the "high-top" or basketball shoe of FIG. 1. Thus, the shoelace cover 1 illustrated in the figures is shaped to fit on top of the shoelaces 18 of a high-top shoe. If the shoe 10 were a "low-top" shoe, for example a running shoe, the shoelace cover 1 would be designed to fit the throat of such a shoe. For example, the shape of the edge element 2 would still be generally triangular, but the riser sections 21 would not be required and thus, the "L- shape" shown in the side view of FIG. 2 would not exist. Further, the shoelace cover 1 may be fabricated in different sizes to fit over the throat of different size shoes.

Figure 4:
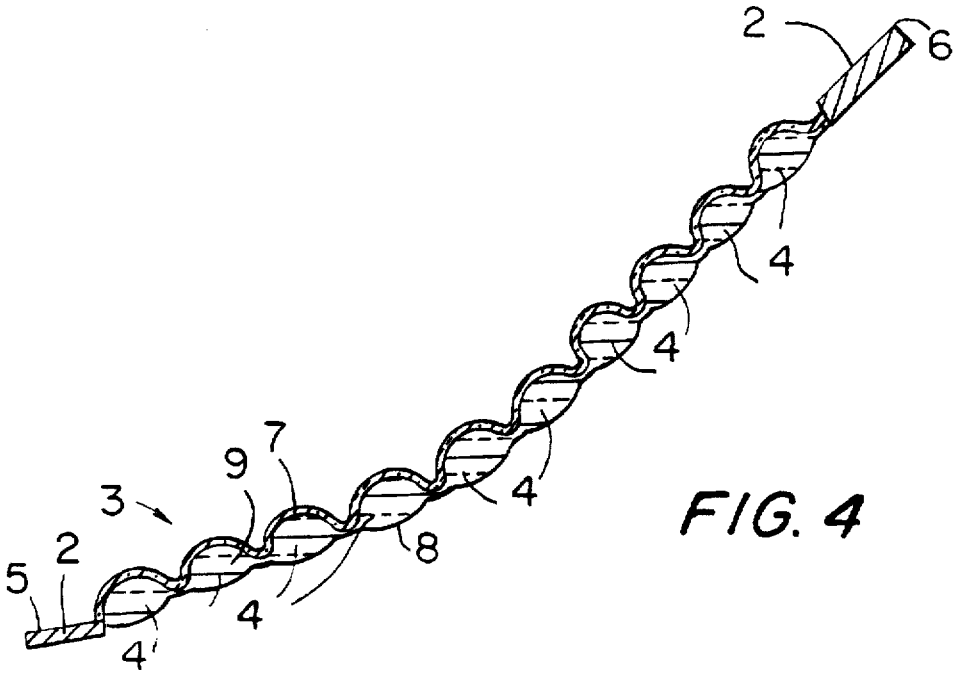
FIG. 4 is a cross-sectional view taken along line A—A of the shoelace cover of FIG. 3.

FIG. 4 is a cross-sectional view of the shoelace cover 1 taken along line A—A of FIG. 3. The tubular window elements 4 are preferably composed of a deformable plastic or rubber material, and traverse the distance between lace length sections 20 (see FIGS. 2 and 3). Each window element 4 of the translucent window 3 has a top layer 7 and a bottom layer 8 which together define a generally spherical cross-section, as shown. The core 9 of each window element 4 may be filled with air, gel, a resilient plastic material or other translucent and preferably deformable material. The window elements 4 together serve to display and protect the shoelaces, and further protects the foot of a wearer by absorbing the energy from a blow, for example, from a soccer ball or the like striking the shoelace cover.

Figure 5:
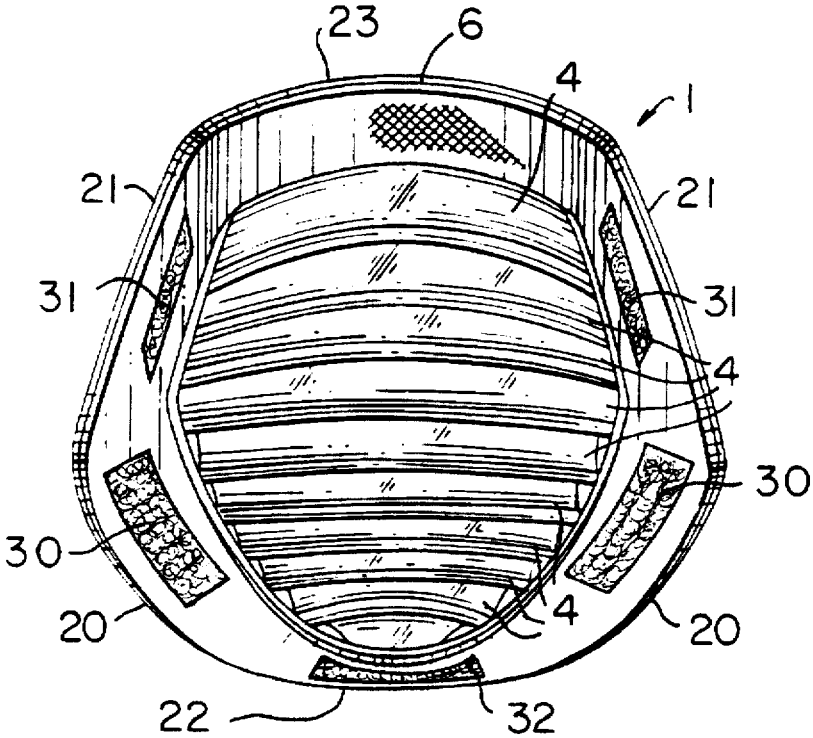
FIG. 5 is an end view of the shoelace cover of FIG. 1.

FIG. 5 is an end view sighting down the longest dimension of the shoelace cover 1 of FIG. 3, from the throat spanning section 23 to the toe spanning section 22. The underside, or the side of the translucent window 3 that contacts the shoelaces, can be seen. As shown, the shoelace cover 1 is slightly channel-shaped to conform to the throat area of the shoe upper, and thus the window elements 4 are slightly bowed to conform to this shape, as can be seen in FIG. 1. Fasteners 30 are shown attached to the underside of the lace length sections 20, fasteners 31 are shown attached to the underside of riser sections 21, and a fastener 32 is shown attached to the underside of the toe spanning section 22. Although a specific configuration of fasteners is shown, other groupings may be utilized. For example, the fasteners 30 may be adequate by themselves for some applications to keep the cover 1 detachably connected to the upper of the shoe. The fasteners may be of the hook-and-loop type of fasteners sold under the trademark "Velcro", or of any other type of detachable fastener. In addition, a strip of such fasteners may ring the entire underside of the edge element 2 if desired. However, in general, there is no need to provide a fastener beneath the throat spanning section 23 because a wearer typically reaches underneath the shoelace cover in this area with her hand to detach the shoelace cover to gain access to the shoelace.

Figure 6:
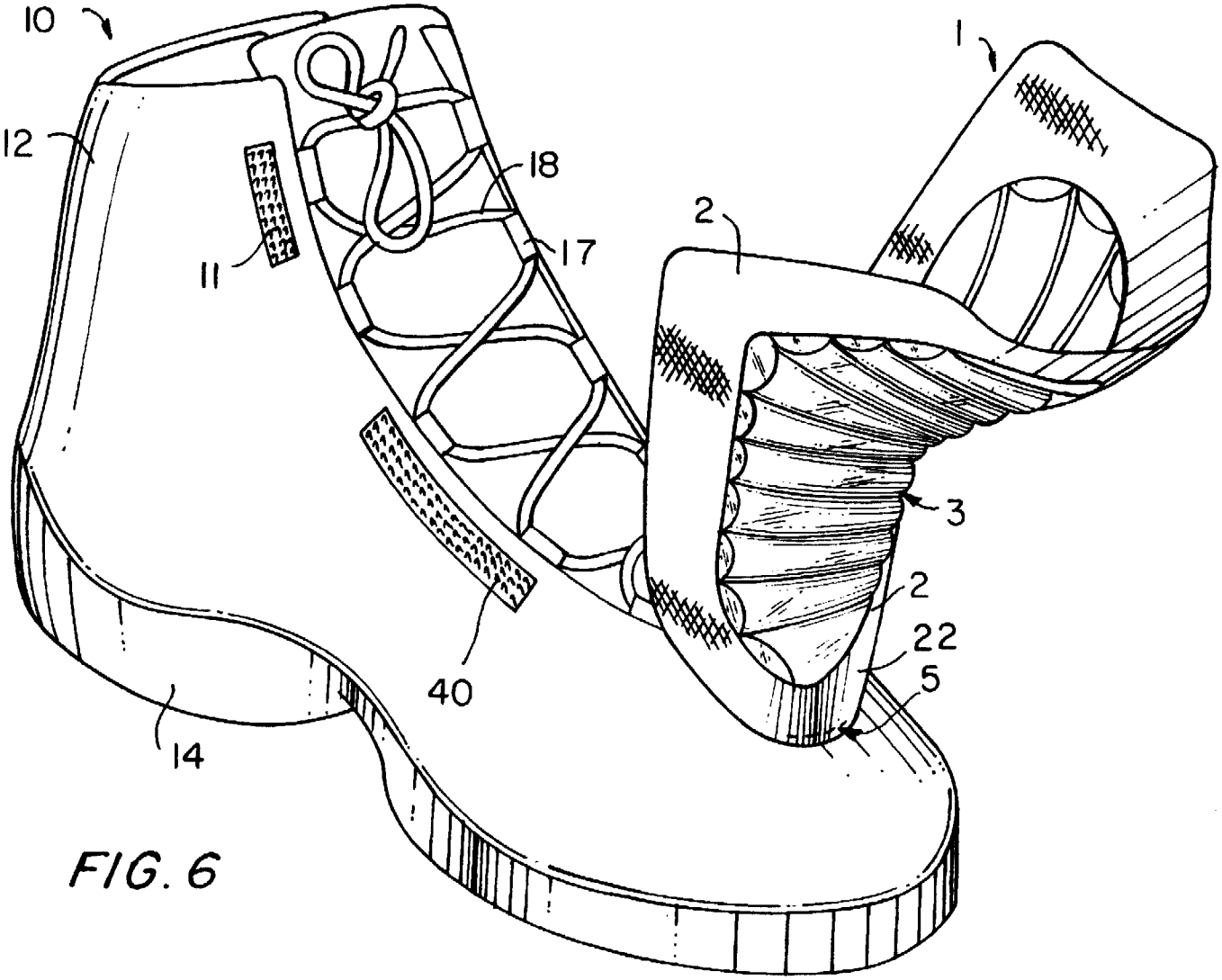
FIG. 6 is a perspective view of the shoe of FIG. 1 showing the shoelace cover bent over in a forward position to allow access to the shoelace.

FIG. 6 illustrates the shoe 10 of FIG. 1 with the shoelace cover 1 bent over in a forward position to allow access to the shoelace 18. In this example the toe spanning section 22 of the edge element 2 is permanently affixed near the toe area of the shoe. For example, the toe spanning section 22 may be sewn, rivetted, glued or otherwise permanently attached to the upper of the shoe. However, the toe spanning section 22 along with the other parts of the shoelace cover 1 may be detachably affixed to the upper 12 of the shoe, so that the cover 1 can be totally removed from the shoe 10.

FIG. 6 also depicts mating fasteners 40 and 41 affixed to the shoe upper 12 on one side of the throat which match with fasteners 30 and 31 on the underside of the shoelace cover 1 as shown in FIG. 5. Of course, other fastener configurations could be used which are readily apparent to one skilled in the art.

Although the invention has been described with reference to a specific embodiment, many variations or modifications would be apparent from the above description which do not depart from the spirit and scope of the invention, which is defined by the appended claims.

What is claimed is:

1. A protective shoelace cover for substantially covering the shoelaces of a shoe, wherein the shoe comprises a sole and an upper having a throat, the shoelace cover comprising:

a generally triangular edge element sized to fit over the throat of the shoe, the edge element having an inner portion;

fastening means connected to the underside of the edge element for detachably securing the cover to the upper on opposite sides of the throat; and a translucent window of deformable, shock-absorbing material connected to the inner portion of the edge element.

2. The shoelace cover of claim 1, wherein the fastening means comprises:

a hook and loop fastener.

3. The shoelace cover of claim 1, wherein the edge element is fully detachable from the upper of a shoe.

4. The shoelace cover of claim 1, wherein a toe section of the edge element is permanently attached to the upper of a shoe, and wherein other portions of the edge element are detachably connectable.

5. The shoelace cover of claim 1, wherein the translucent window is comprised of a plurality of rod-shaped members.

6. The shoelace cover of claim 5, wherein the rod-shaped members are filled with air.

7. The shoelace cover of claim 5, wherein the rod-shaped members are filled with gel.

8. The shoelace cover of claim 5, wherein the rod-shaped members are composed of a deformable plastic material.

9. The shoelace cover of claim 1, wherein the translucent window is tinted.

10. The shoelace cover of claim 1, wherein the translucent window contains an insignia.

* * * * *